US006076386A

United States Patent [19]

Etchells et al.

[11] Patent Number: 6,076,386

[45] Date of Patent: Jun. 20, 2000

[54] REMOVABLE PLUG LOCK

[75] Inventors: Garry Michael Etchells; Brian Francis Preddey, both of Fairy Meadow, Australia

[73] Assignee: Australian Lock Company Pty Ltd., Australia

[21] Appl. No.: 09/155,290

[22] PCT Filed: Mar. 20, 1997

[86] PCT No.: PCT/AU97/00178

§ 371 Date: Sep. 24, 1998

§ 102(e) Date: Sep. 24, 1998

[87] PCT Pub. No.: WO97/36072

PCT Pub. Date: Oct. 2, 1997

[30] Foreign Application Priority Data

Mar. 25, 1996 [AU] Australia ..... PN8901

[51] Int. Cl.[7] ..... E05B 27/00

[52] U.S. Cl. ..... 70/369; 70/495; 70/358

[58] Field of Search ..... 70/367, 369, 337, 70/340, 382, 375, 495, 496, 358, 492, 493

[56] References Cited

U.S. PATENT DOCUMENTS

| | | | |
|---|---|---|---|
| 1,908,672 | 5/1933 | Jacobi . | |
| 2,065,683 | 12/1936 | Gahagan . | |
| 2,097,190 | 10/1937 | Jacobi . | |
| 2,268,511 | 12/1941 | Ledin . | |
| 2,370,862 | 3/1945 | Johnstone . | |
| 2,418,080 | 3/1947 | Ledin et al. . | |
| 3,667,264 | 6/1972 | Surko, Jr. et al. . | |
| 4,191,037 | 3/1980 | Patriquin . | |
| 4,398,405 | 8/1983 | Patriquin . | |
| 4,444,034 | 4/1984 | Best et al. . | |
| 4,603,565 | 8/1986 | Stassmeir | 70/358 |
| 4,672,827 | 6/1987 | Craig . | |
| 4,715,201 | 12/1987 | Craig . | |
| 4,809,525 | 3/1989 | Cox | 70/369 |
| 5,070,715 | 12/1991 | Smallegan et al. . | |
| 5,101,649 | 4/1992 | Duval . | |
| 5,119,654 | 6/1992 | Ceron et al. | 70/369 |
| 5,121,618 | 6/1992 | Scott . | |
| 5,209,087 | 5/1993 | Cox . | |
| 5,226,304 | 7/1993 | Scott . | |
| 5,375,444 | 12/1994 | Smith | 70/495 |
| 5,421,179 | 6/1995 | Bergström . | |
| 5,431,034 | 7/1995 | Fann et al. | 70/337 |
| 5,507,163 | 4/1996 | Juang . | |
| 5,617,750 | 4/1997 | Preddey | 70/495 |

*Primary Examiner*—Darnell Boucher
*Attorney, Agent, or Firm*—Quarles & Brady LLP

[57] ABSTRACT

A lock with a plug (2) removable from a housing (16) is disclosed. The plug (2) includes a restraining member (46) and a protrusion (40) which engages a concentric groove (52) formed onto a plug housing. Intersecting the concentric groove is a longitudinal groove (50). Upon inserting an operation key the restraining member is forced into engagement with the concentric groove thereby preventing plug removal even upon alignment of the protrusion with the longitudinal groove (50). Upon inserting a removal key (42) the restraining member (46) is disengaged from the concentric groove so that the plug may be withdrawn upon rotationally aligning the protrusion (40) with the longitudinal groove (50). In this manner a simple and compact removable plug is provided to aid rapid lock re-keying.

18 Claims, 2 Drawing Sheets

REMOVABLE PLUG LOCK

TECHNICAL FIELD

The present invention relates to lock and lock cylinders, particularly of the type allowing the lock to be re-keyed by simply interchanging the lock plug.

BACKGROUND ART

Locksmiths typically use several relevant terms interchangeably when referring to particular features associated with locks. To avoid confusion the following terms will be assumed to be used in the following sense throughout the description and claims.

In a lock of the pin tumbler or similar type, the lock comprises a central plug and an outer housing or shell, in which the plug rotates, the housing being mounted in a suitable latch structure. The terms plug and housing will be used in this context. Similarly, it will be appreciated that the present invention may be applied to any type of latch structure for which pin tumbler and related locks are used, for example, cam locks, door locks, phone locks and security fittings.

A number of prior disclosures describe devices intended to provide a removable plug or lock core arrangement. The advantages of removable plug locks is that they may be rapidly re-keyed by relatively unskilled personnel. Such re-keying may be required as a result of a potential security breach occuring due to the loss or non-return of a key. The present invention is particularly concerned with locks of the type in which the plug contains the complete combination of coded pins or similar elements. An example of this type of lock is the BILOCK™ device sold by the applicant. The keying of such locks can be altered by simply replacing the plug without involving any other elements. Locks of this type typically have one or more side bars extending between the plug and the housing in the locked condition to engage a complementary recess formed into the inside surface of the housing thereby preventing plug rotation and associated latch movement.

One type of lock featuring a removable keying mechanism is disclosed in U.S. Pat. No. 5,226,304 to Scott in which is described an arrangement for removing an entire lock core consisting of a plug surrounded by an interchangeable bracket, with radial projection housing the lock tumblers. In its retained state the core is held to the surrounding housing by two sets of balls forced by the cylinder body to protrude through crimp holes in the core bracket so as to engage ball grooves in the surrounding housing. Core removal is by withdrawal of the retaining balls, one set of balls being withdrawn into notches of a removal key and another set being withdrawn into dimples in the outer surface of the cylinder body on rotation of the cylinder. In contrast the present invention is simpler and relies on retaining balls operating directly between the plug and the housing. In a retained state according to the present invention one set of retaining balls located in the plug is forced into engagement with a groove in the housing by the insertion of an operation key thereby preventing plug withdrawal.

Another group of known removable core devices uses an extended removal key to facilitate core removal in contrast to a shorter standard length operation key which is used during normal operation of the lock. A removable core lock according to this scheme has a special pin distal from the keyway entrance and accessible by the removal key. Such an arrangement necessitates a longer housing assembly than is required in a non-removable core lock and hence in many cases cannot be retrofit on to existing systems. Examples of this type include U.S. Pat. No. 4,715,201 to Craig, U.S. Pat. No. 4,191,037 and U.S. Pat. No. 4,398,405 to Patriquin, U.S. Pat. No. 5,101,649 to Duval, and U.S. Pat. No. 5,121,618.

Another approach has been to use pins with multiple tumblers so that more than one shear line can be generated. In devices of this type insertion of an operation key generates a shear line allowing operation of the lock but not removal of the core. Insertion of a removal key produces a different shear line which transmits force to a withdrawal mechanism. An example of such a system is disclosed in U.S. Pat. No. 5,507,163 to Juang in which a key assembly is held to the door handle it is to be inserted in by flanges on a ring located midway down the length of the lock assembly. The ring may be rotated due to the action of a special key and multi-segmentation of the middle two lock tumblers. These tumblers form a shear line which selectively transmits rotational force applied to the key to the operative ring thereby rotating the ring to a position in which disengagement is possible. Similarly in U.S. Pat. No. 3,667,264 to Surko a control key generates two shear lines positioned to allow a medially placed engagement latch to be rotated into and out of the core. When rotated into the core the lock assembly can be withdrawn from its housing.

It is an object of the present invention to provide an arrangement for removing only the plug of a lock so as to facilitate re-keying, and further for the invention to be installable within a conventional latch mechanism. By the invention two types of key are provided a first operation key for standard locking and unlocking of the lock and a removal key by which an operator may withdraw the plug from the housing.

SUMMARY OF INVENTION

According to the present invention there is provided a removable plug lock including a plug which is rotatable by means of a correctly keyed operation key and rotatable and removable by means of a removal key, wherein said operation key operatively forces at least one plug restraining member to protrude from the surface of said plug and wherein said removal key operatively permits movement of at least one plug restraining member to a plug withdrawal position, comprising:

- a plug of substantially cylindrical configuration including,
  - a keyway, and recesses adapted to locate a restraining member;
- a lock housing including,
  - a cylindrical cavity for slideably receiving the plug, said lock housing having upon its internal surface a concentric groove being concentric to said longitudinal cavity and an internal longitudinal slot said longitudinal slot intersecting said concentric groove;
- a restraining member substantially located within one of said recesses of said plug,
  - said restraining member being adapted to form a first protrusion, from the surface of said plug onto a circle concentric with the axis of said lock plug, upon application of force to the restraining member from within the keyway;
- a second protrusion from the surface of said plug upon said circle, characterised in that,
  - the lock is operable in a first mode by insertion of said operation key in the keyway to unlock said lock and apply force to said restraining member
  - thereby forcing said restraining member to protrude from the surface of said plug into said concentric groove thereby preventing removal of said plug, further characterised in that, the lock is operable in a second mode by insertion of said removal key characterised by a configuration which unlocks said lock and permits entry of said restraining member into said keyway, so that said plug may be rotated to align said second protrusion with said slot thereby allowing removal of said plug.

BRIEF DESCRIPTION OF DRAWINGS

An embodiment of the present invention will now be described with reference to the accompanying figures, in which.

DESCRIPTION OF THE PREFERRED EMBODIMENT

The present invention will be discussed in the context of the BILOCK™ devices manufactured and sold by the applicant. It is emphasised, however, that in addition the present invention is readily applicable to single bladed key systems or any lock arrangement using a central plug containing the complete set of lock coding elements, with suitable modifications to the recesses and restraining arrangement as will be discussed below.

Figure 1:
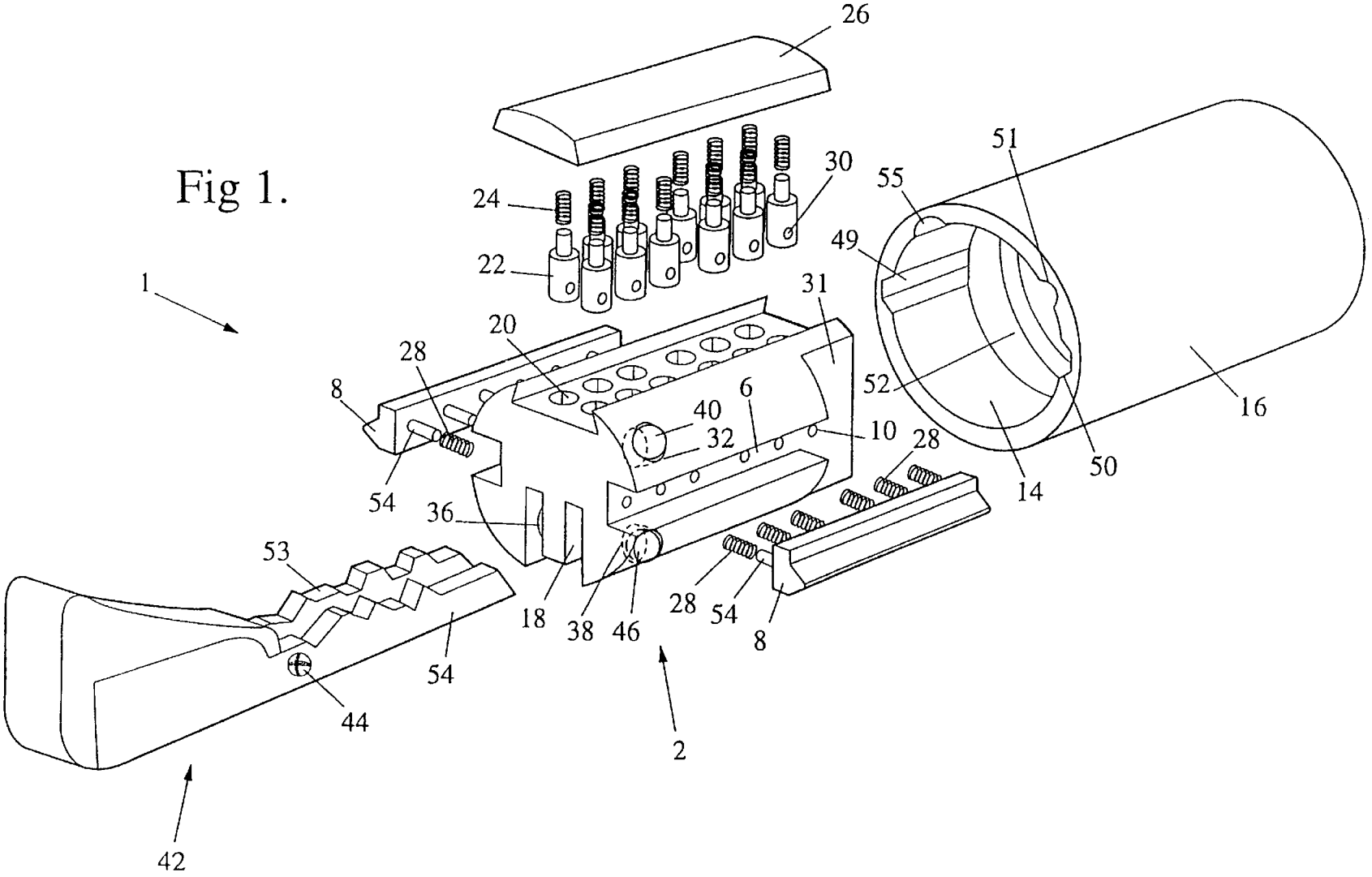
FIG. 1 is an exploded view of an embodiment of the present invention.

Referring to FIG. 1, a removable plug lock 1 has a removable plug 2 slideably received in a longitudinal cavity 14 of a housing 16. As is well known, the removable plug 2 has a keyway 18 and a plurality of tumbler bores 20 aligned with the keyway 18 and receptive to pin tumblers 22. The tumblers 22 are inwardly biased in the tumbler bores 20 by tumbler springs 24 which in turn are secured in the bores 20 by a cover 26. The tumblers each feature a transverse tumbler pin hole 30 as is known in the art of sidebar locks. On either side the plug features a longitudinally disposed sidebar recess 6 for the accommodation of sidebars 8. The sidebars feature a series of pins 54 along the plug side and are biased away from the plug by sidebar springs 28 or other biasing means as known in the art. A series of transverse bores 10 are provided through the plug along each of the sidebar recesses. The transverse bores each communicate with tumbler bores 20 and match up with pin holes 30 upon insertion of a correct key thereby allowing withdrawal of sidebar 8 into sidebar recess 6 upon application of sufficient force to overcome sidebar springs 28. At the end of the plug opposite the key entry the body of the plug is flattened 30 on either side to provide a suitable means for interacting with a latch mechanism.

According to the invention four holes 32, 34, 36, 38 are formed in the plug, with hole 34 not visible in FIG. 1. The holes extend with their centerlines in a plane normal to the plug axis from the surface of the plug to the interior. Each of the holes is located at the same distance from the keyway end of the plug. Holes 34 and 32 are blind holes of diameter and depth such that protruding balls 40 and 41 protrude from the surface of the plug. Also according to the invention holes 38 and 36 communicate with keyway 18 and upon insertion of removal key 42 holes 36 and 38 terminate upon key dimples 44 of which only one is visible in FIG. 1. Holes 38 and 36 contain plug restraining members comprising balls 46 and 48, and are arranged relative to the keyway so that upon insertion of an operation key, which does not feature dimples 44, balls 46 and 48 are forced to protrude from the outer surface of the plug. It is envisaged that each of holes 32, 34, 38, 36 will feature some type of ball retention means, for example staking of the balls or a slight overhang at either end of the holes, though only to an extent which will not interfere with ball protrusion. It will be understood that in an alternative lock mechanism, for example one receptive to a single rather than a double bladed key, the balls 46, 48 would have to be repositioned. Furthermore, in such a situation the holes 38 and 36 may be lengthened in order to facilitate repositioning so that an alternative means to the ball, for example a cylindrical element with rounded ends or a rod carrying a ball at either end, could be used to produce an equivalent system. It will be appreciated that various implementations are possible.

Figure 2B:
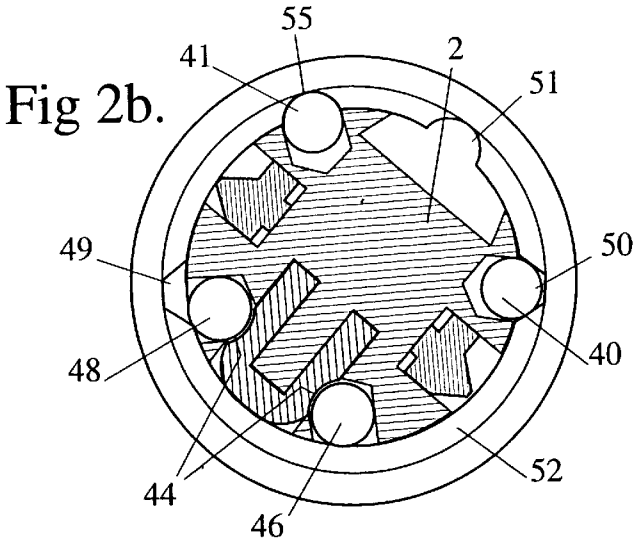
FIG. 2 illustrates in section the operation of the inventive mechanism according to the embodiment of FIG. 1.
Figure 2D:
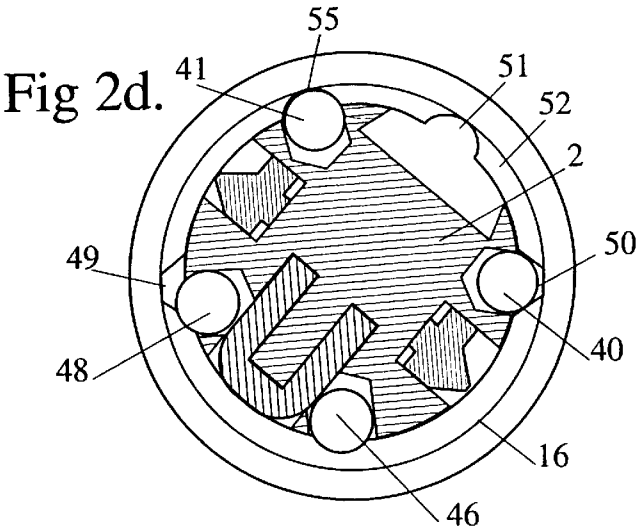

Plug housing 16 features a longitudinal cavity 14 of slightly larger diameter than the plug. The housing features two longitudinal sidebar slots 49, 50 adapted to receive sidebars 8 when the sidebars are in a locked configuration. The housing further features an internal concentric groove 52 which accommodates protruding balls 40 and 41 and balls 46 and 48 when they are in the protruded state. Longitudinal grooves 51 and 55 are formed into the sides of the housing and are of a dimension sufficient to accomodate the protruding portions of protruding balls 40 and 41. Referring to FIG. 2D it is seen that the angle formed by the groove 55 the axis of the housing cavity and the slot 50 is the same as that between protruding ball 41 the axis of the housing cavity 14 and the protruding ball 40 so that upon clockwise rotation of the plug, as will be shortly described, it is possible to align ball 41 with groove 55 and ball 40 with slot 50. Similarly, as the arrangement of grooves and slots is symmetrical about the keyway, upon counter clockwise rotation of the plug it is possible to align ball 40 with groove 51 and ball 41 with slot 49. For the purposes of explanation the invention will be explained and illustrated with reference to clockwise rotation of the plug.

Referring now to FIG. 2 the general principle of the present arrangement will be explained with the aid of four depictions of a cross section of the lock through concentric groove 52 viewed from the key end of the plug as shown in FIG. 1. FIGS. 2C and 2D show the relative positions of the lock's elements upon insertion of a conventional operation key and rotation of the plug, in contrast FIGS. 2A and 2B show the lock after insertion of a removal key and subsequent rotation. Considering firstly FIG. 2C it can be seen that upon insertion of a correct operation key 45 the two dimple free key edges 54 and 53 will ensure that balls 48 and 46 protrude from the outer openings of holes 36 and 38 into concentric groove 52. Additionally protruding balls 40 and 41 also protrude into concentric groove 52. Insertion into the keyway of operation key 45 facilitates alignment of sidebar pins 54 with tumbler pin holes 30 so that the sidebars 8 may be withdrawn into recesses 6 upon application of force sufficient to overcome sidebar springs 28. Upon the operator exerting a clockwise rotational torque to the plug 2 by means of key 45 the sidebars are forced into sidebar recesses 6 by means of the angled walls of sidebar slots 49, 50. The key may then be rotated further and will come to a position as shown in FIG. 2D. In that position ball 40 is aligned with sidebar slot 50 so that it is no longer longitudinally restrained with respect to housing 16 by concentric groove 52. Simultaneous with the alignment of protruding ball 40 with sidebar slot 50 is the alignment of protruding ball 41 with longitudinal groove 55 so that ball 41 like ball 40 is no longer longitudinally restrained. However, although balls 40 and 41 are no longer longitudinally restrained balls 46 and 48 remain held by the concentric groove 52 so that, whilst it is possible to rotate the plug, longitudinal motion relative to the housing 16 is impossible.

Figure 2A:
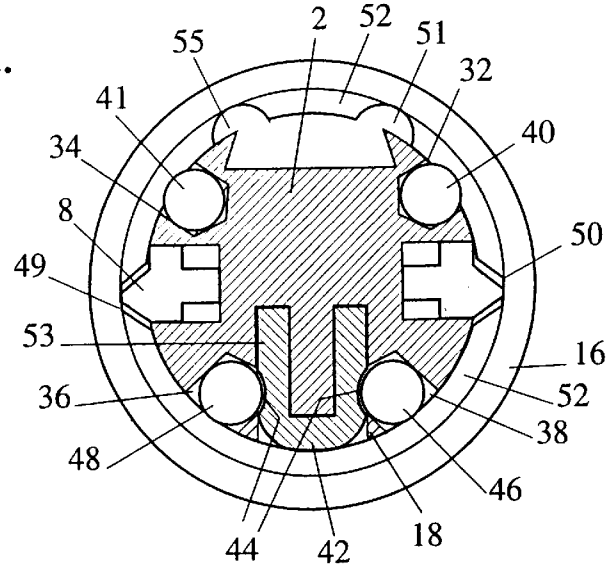
Figure 2C:
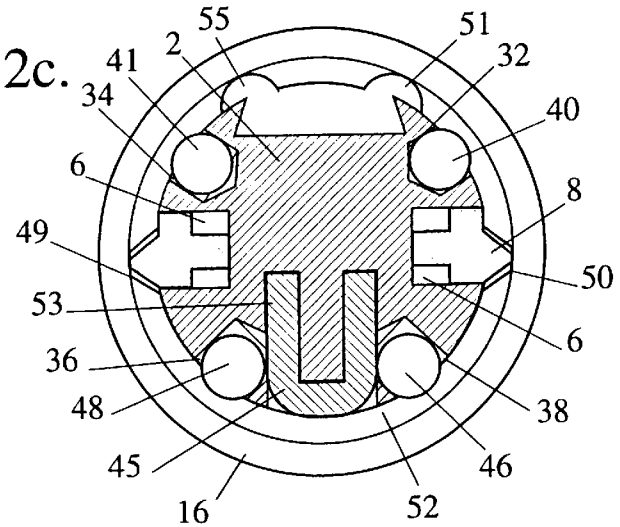

Turning now to FIG. 2A the lock elements are depicted upon insertion of a removal key 42 featuring dimples 44. Dimples 44 align with the internal entrances of holes 36 and 38 so that balls 48 and 46 are not forced to protrude into concentric groove 52. Consequently concentric groove 52 no longer exerts a longitudinal restraining force upon balls 46 and 48. The plug may not be withdrawn from housing 16 however because protruding balls 40 and 41 are longitudinally restrained by concentric groove 52. Since key 42 is correctly coded for the lock its insertion will facilitate alignment of sidebar pins 54 with tumbler pin holes 30 so that the sidebars 8 may be withdrawn into recesses 6 upon application of force sufficient to overcome sidebar springs 28. Upon the operator exerting a clockwise rotational torque to the plug 2 by means of removal key 42 the sidebars are forced into sidebar recesses 6 by means of angled walls of sidebar slots 49, 50. The key may be rotated to the position shown in FIG. 2B. In that position ball 40 is aligned with sidebar slot 50 so that it is no longer longitudinally restrained with respect to housing 16 by concentric groove 52. Simultaneous with the alignment of ball 40 with sidebar slot 50 is the alignment of ball 41 with longitudinal groove 55 so that ball 41 like ball 40 is no longer longitudinally restrained. In addition balls 48 and 46 are no longer restrained longitudinally by reason of their clearance of groove 52 due to their accomodation into dimples 44. Consequently plug 2 may be withdrawn from housing 16 and replaced with an alternative plug or re-keyed as desired.

The operation of the lock is entirely analogous upon counter clockwise rotation of the plug whereby counter clockwise rotation produces simultaneous alignment of ball 40 with groove 51 and ball 41 with slot 49.

It will be appreciated that variations of the implementation details, and additions, may be made within the general inventive concept. For example, according to another embodiment of the invention although the plug is formed as described above the housing omits longitudinal grooves 55 and 51. According to this embodiment it is required that only one or other of protruding balls 40 and 41 be present depending on whether the lock is right or left handed. The plug is withdrawn by inserting the dimpled withdrawal key and rotating the plug so that the retaining ball is aligned with a longitudinal slot. Whilst this latter embodiment is in accordance with the invention the plug is less securely held within the housing than in the first described embodiment as the absence of protruding ball 41 reduces the number of points at which the plug 2 is engaged by groove 52 during standard operation of the lock. Additional variations and embodiments of the invention will be apparent to those skilled in the relevant art.

What is claimed is:

1. A removable plug lock including a plug which is rotatable by means of a correctly keyed operation key and rotatable and removable by means of a removal key, wherein said operation key operatively forces at least one plug restraining member to protrude from the surface of said plug and wherein said removal key operatively permits movement of at least one plug restraining member to a plug withdrawal position, comprising:

a plug of substantially cylindrical configuration including, a keyway, and recesses adapted to locate a restraining member;

a lock housing including, a cylindrical cavity for slideably receiving the plug, said lock housing having upon its internal surface a concentric groove being concentric to said longitudinal cavity and an internal longitudinal slot said longitudinal slot intersecting said concentric groove;

a first restraining member substantially located within one of said recesses of said plug, said first restraining member being adapted to form a first protrusion, from the surface of said plug into said concentric groove, upon application of force to the first restraining member from within the keyway;

a second protrusion from the surface of said plug which protrudes into said concentric groove, characterized in that, the lock is operable in a first mode by insertion of said operation key in the keyway to unlock said lock and apply force to said first restraining member thereby forcing said first restraining member to protrude from the surface of said plug into said concentric groove thereby preventing removal of said plug, further characterized in that, the lock is operable in a second mode by insertion of said removal key characterized by a configuration which unlocks said lock and permits entry of said first restraining member into said keyway, so that said plug may be rotated to align said second protrusion with said slot thereby allowing removal of said plug.

2. The removable plug lock of claim 1, wherein the second protrusion, restraining member and slot are arranged whereby upon insertion of said operation key and alignment of the second protrusion with said slot, said restraining member is restrained from longitudinal motion.

3. The removable plug of claim 1, wherein said lock housing further includes at least one longitudinal groove intersecting said concentric groove and said plug includes a third protrusion from the surface of said plug upon said circle, wherein in section the angle between said longitudinal groove the axis of said cylindrical cavity and said slot is congruent to the angle between said third protrusion said axis and said second protrusion, so that the removable plug lock is further characterized in a second mode of operation in that upon rotating said plug to align said second protrusion with said slot said third protrusion is simultaneously aligned with said longitudinal groove thereby allowing removal of said plug.

4. The removable plug lock of claim 1, wherein said second protrusion comprises a portion of a ball located within a blind bore driven into the plug.

5. The removable plug lock of claim 1, wherein said restraining member comprises a ball.

6. The removable plug lock of claim 1, wherein said restraining member is located within a recess configured as a bore communicating between the keyway and surface of said plug wherein said surface is adjacent the cylindrical cavity.

7. The removable plug lock of claim 6, wherein said restraining member has a dimension greater than the length of the centerline of said bore.

8. The removable plug lock of claim 1, including at least two restraining members.

9. The removable plug lock of claim 1, wherein the internal longitudinal slot Of said lock housing is a sidebar slot.

10. The removable plug lock of claim 1, wherein said removal key permits movement of at least one plug restraining member into said keyway by means of at least one recess formed into at least one side of a blade of the removal key.

11. The removable plug lock of claim 7, wherein said operation key forces at least one plug restraining member to protrude from the surface of said plug by substantially filling said keyway thereby forcing the plug restraining member to protrude from the surface of said plug.

12. The removable plug cylinder lock of claim 11, wherein said restraining member protrudes into said concentric groove.

13. The removable plug lock of claim 1, wherein said concentric groove forms a ring around the internal surface of said lock housing.

14. The removable plug lock of claim 1, wherein said restraining member is substantially located within a recess configured to allow said member to protrude from said recess.

15. The removable plug lock of claim 14, wherein said recess is configured to prevent said restraining member from escaping.

16. The removable plug lock of claim 15, wherein said recess is configured to prevent said restraining member from escaping by means of staking of said restraining member.

17. The removable plug lock of claim 1, wherein said concentric groove features sides adapted so that upon withdrawing said plug from said housing said concentric grooves in cooperation with said recesses apply force to said restraining member directing said restraining member into the body of the plug.

18. The removal plug lock of claim 1, wherein only the first restraining member is able to communicate with the keyway, the keyway at all times being inaccessible to the second restraining member.

* * * * *